United States Patent [19]

Liardet

[11] Patent Number: 4,864,790

[45] Date of Patent: Sep. 12, 1989

[54] LEATHER FLOOR

[76] Inventor: André Liardet, 16808 Avenida Florencia, Poway, Calif. 92064

[21] Appl. No.: 199,158

[22] Filed: May 26, 1988

[51] Int. Cl.[4] ..... E04F 15/02

[52] U.S. Cl. ..... 52/311; 52/316

[58] Field of Search ..... 52/311, 316; 428/48, 428/60

[56] References Cited

U.S. PATENT DOCUMENTS 2,316,351 4/1943 Miller ..... 428/48

3,209,500 10/1965 Bernett ..... 428/48

FOREIGN PATENT DOCUMENTS 2377498 2/1978 France ..... 428/60

25935 of 1906 United Kingdom ..... 428/60

*Primary Examiner*—Carl D. Friedman

*Assistant Examiner*—Lan Mai

*Attorney, Agent, or Firm*—Dressler, Goldsmith et al.

[57] ABSTRACT

A planar base material, typically of Masonite® brand compressed wood, and a thick flexible leather are each cut to an identical geometrical shape suitable for use as a tile within a tessellation. The top side surface of the composite wood underlay is contoured with shallow undulations, typically up to 1/64" deep over a linear extend of 12". The top side peripheral edges of the composite wood underlay and the bottom side peripheral edges of the leather overlay are both beveled. The leather overlay is adhesively bonded, typically by brush-on type contact adhesive, to the composite wood underlay, forming thereby a composite multi-layer laminate leather tile. The edges of tile so formed are well suited visually and functionally for abutting one tile to the next. The major surface of the tile is aesthetically pleasing without presenting any visual flat spots. The composite tiles may optionally be embossed, stained, sealed, and/or waxed upon their upper and edge surfaces.

17 Claims, 1 Drawing Sheet

FIG. 1
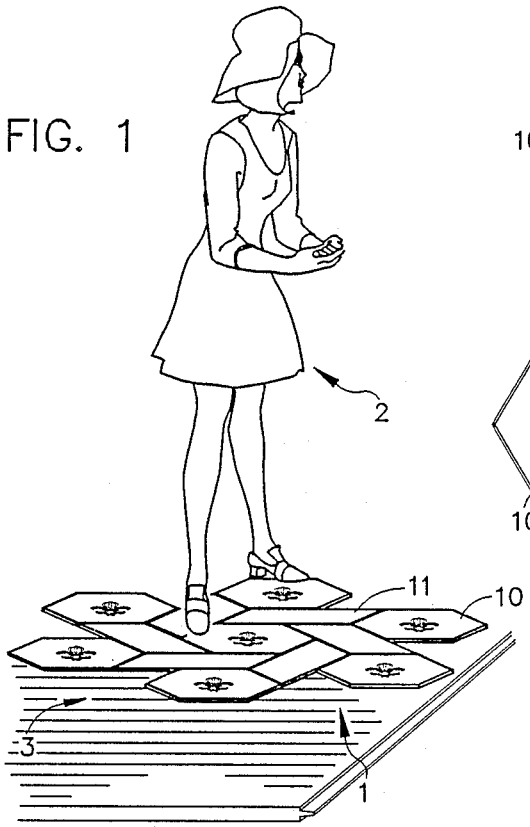
FIG. 2
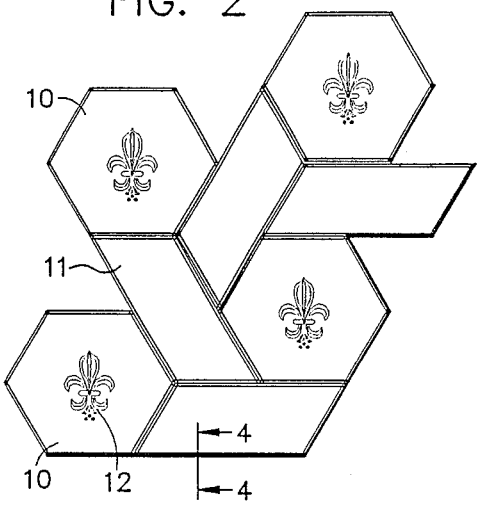
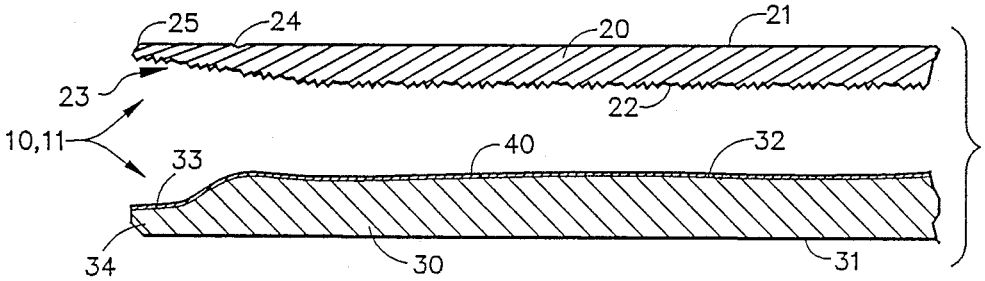
FIG. 3
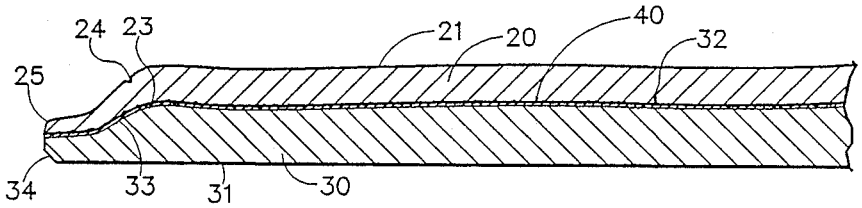
FIG. 4

LEATHER FLOOR

BACKGROUND OF THE INVENTION

1. Field of the Invention

The present invention concerns floors constructed of leather, and particularly floors constructed from leather floor tiles.

2. Background of the Invention

Leather is a common material which is, nonetheless to its commonness, exotic of application in flooring.

Leather might be considered unsuitable for use in floors, but this is a misconception. Tanned leather is generally available in thicknesses up to 3/16". The greater thicknesses of leather exhibit considerable resiliency under foot. Thick leather is suitably wear resistant for all but high traffic areas. It is substantially puncture resistant, even to womens' high heels. Damage to the surface of stained and/or varnished leather can normally be readily repaired by the addition of further stain or varnish as the case requires.

Leather is a relatively expensive material for floors, but is not a functionally unsuitable material for floors. A certain previous paucity of use of leather in floor surfaces is probably due more to the aesthetic appearance of leather in this application than to its functional suitability. The use of leather underfoot is as old as the spreading of hides upon the ground by primitive man. However, when leather is applied to flat flooring surfaces such as are typical in modern buildings then the appearance of the leather floor so created has not been aesthetically optimal.

The mere application of leather to a planar flooring surface produces a leather-surfaced floor having a substantially dull and lifeless appearance. The sensuous visual appeal of leather is substantially diminished, or lost altogether, when broad expanses of leather are laid in a substantially flat plane, as upon a floor. A substantially planar leather floor surface shows substantial areas that strongly reflect light and that gloss brightly over a range of light incidence angles. Meanwhile, other areas, at other light incidence angle ranges, do not reflect light to an observer's eye and appear dull.

Light in rooms typically comes from only a few sources, such as the sun. A flat leather floor illuminated from just a few light sources will typically show a bright gloss over an area, typically of several square feet, that is adjacent to a relatively darker and duller area. The visual effect of the bright and dull areas shifts with the visual angle of the viewer. Not only is this visual effect not aesthetically pleasing, it actually replicates the light reflectivity of inferior flooring materials such as linoleum.

A large flat leather floor is jarring to the sensibilities. It is generally outside the common experience of most people who have, at times, walked on wood, metal, plastic and ceramic as well as upon all types of natural terrain. Yet leather is a very popular, luxury, material in demanding applications such as luggage and saddlery. The scarcity of leather floors may be indicative that such floors have not been widely realized with satisfactory aesthetic results, and not that such floors cannot technically be realized.

Improvements to the aesthetic visual appearance of a leather floor are desired. The leather upon a floor surface might be patterned, textured, or otherwise altered in order to improve its visual appearance. However, such alterations to the surface of the leather would diminish its serviceability in flooring applications while generally failing to recapture the aesthetic appeal that leather should generally possess, and that seems to be lost in its application in flooring.

SUMMARY OF THE INVENTION

The present invention is based on the discovery that broad, planar, expanses of leather such as in leather floors must be slightly, almost imperceptively, undulating in order to exhibit maximum visual appeal. The reason why this principle holds true is not known. The human eye is not offended by planar floors of wood or ceramic tile, although the natural occurrence of these substances in planar form is nearly so rare as those animals that exhibit any substantially flat area of hide. It is suspected that the apparent porous texture of a leather surface (although the leather may not, in fact, be porous) is inconsistent with broad expanses of bright reflectivity, and that the undulating floor surfaces of the present invention create a subdued visual appearance more compatible with the texture of leather.

The present invention is embodied in a leather floor, and in a method of making a leather floor. The leather floor in accordance with the present invention includes a substantially planar base-material underlay having an undulating upper surface, typically created by grinding or sanding, to which is affixed a substantially planar, substantially even thickness, overlay of flexible leather. An adhesive bonding layer permanently affixes the leather overlay to the base-material underlay so that the flexible leather assumes the surface undulations of the base-material underlay. The base-material underlay and the leather overlay are preferably each separately patterned as tiles, suitable for use in a tessellation, of equal shape and area. The adhesive bonding of the base-material underlay tile to the leather overlay tile produces a composite multi-layer laminate tile.

Further in accordance with the present invention, both the base-material underlay tile and the leather overlay tile are extensively worked at their peripheral edge regions prior to being bonded together. The top side peripheral edges of the underlaid base-material tile are beveled, preferably by planing. The bottom side peripheral edges of the overlaid tile are also beveled, again preferably by planing. The bottom side bevel of the overlaid leather tile is preferably both wider and shallower than the top side bevel of the underlaid base-material tile.

When the underlaid base-material tile and the overlaid tile are adhesively bonded then the composite multi-layered laminate so formed is of reduced thickness at its periphery, further enhancing its visual appeal. Further beveling of both the top side and the bottom side peripheral edges of the composite multi-layer laminate tile is also preferably performed. The top side leather surface to the composite laminate tile is optionally provided with a burnishing groove at its periphery and/or with an embossment in its center regions. The tile may be stained and sealed on any of its surfaces, especially on its upper and edge surfaces.

The contours of the composite multi-layer laminate leather floor tiles so formed are subtle, but sensuous. The tiles appear to have a very, very gently mounded, or pillowy, appearance. A leather floor formed from the tiles gives, due to the slight undulations within the leather surface of the tiles, a rich and warm appearance.

The leather floor is devoid of any extensive regions that appear unaesthetically flat.

The leather floor in accordance with the present invention is subject to mass production by machines and ready installation by construction tradesmen. However, it is preferably the product of a master craftsman. Many processes in creating the floor—including processes of contouring, beveling, embossing, grooving, staining and finishing—are well suited to the expressive talents of a craftsman as opposed to a mere carpenter or tile mason. Each leather floor in accordance with the present invention is preferably handcrafted to be a subtly unique and individualized item. It exudes great luxury, and is suitably incorporated in the finest rooms of great houses and halls of state.

BRIEF DESCRIPTION OF THE DRAWINGS

FIG. 1 is a diagrammatic view showing a preferred embodiment of a leather floor in accordance with the present invention in operative use.

FIG. 2 is a top plan view showing the preferred embodiment of the leather floor, comprised of composite laminate leather floor tiles, in accordance with the present invention.

FIG. 3 is a partially exploded cross-sectional view showing the three layers of the composite laminate leather tile of the floor in accordance with the present invention prior to adhesive bonding.

FIG. 4 is a cross-sectional view showing the composite laminate leather floor tile in accordance with the present invention.

DESCRIPTION OF THE PREFERRED EMBODIMENT

A leather floor 1 in accordance with the present invention is shown operatively disposed underfoot a person 2 (shown in phantom line) in FIG. 1. The preferred embodiment of leather floor shown is comprised of a multiplicity of composite multi-layer laminate floor tiles 10, 11 arranged in a tessellation. The particular pattern shown is an ancient one, and particularly appears in French manor houses that were built before 1500.

The floor 1 in accordance with the present invention need not be comprised of individual tiles 10, 11, but is preferably so comprised. The leather 20 (shown in FIGS. 3 and 4) that forms the surface of the leather floor 1 is preferably patterned and preapplied to underlay 30 (also shown in FIGS. 3 and 4) in order to form composite laminate tiles. Alternatively, the leather 20 may be directly applied, typically in large sheets, to a contiguous floor subsurface 3 in order to form a leather top surface. In this case a monolithic and continuous (save for necessary seams, if any), untiled, floor is created. When the leather surface of the floor is continuous then the floor subsurface 3 (shown in phantom line) is itself contoured, such as by sanding or grinding, into an undulating surface. The contouring of floor subsurface 3 transpires similarly to the manner that underlay 30 is contoured to form an undulating surface (in a manner to be explained).

The floor subsurface 3 to composite multi-layer laminate floor tiles 10–11 is normally, however, both planar and flat. It is typically made from concrete, cement, composite floor board, wood, or any of the materials which are normally used for floor subsurfaces. The floor subsurface 3 is preferably 1⅛" or ¾" plywood assembled tongue and groove and bonded tight to a subfloor. A tongue 4 to a typical 4', by 8', plywood floor subsurface 3 is shown in FIG. 1. This tongue 4 mates with a complementary groove (not shown) on a next adjacent sheet of plywood floor subsurface 3.

The underlay 30 (shown in FIGS. 3 and 4) to the composite tiles 10–11 is preferably a wood or wood composite material. This wood material adhesively bonds especially well to a wood composite floor subsurface (such as the preferred plywood floor subsurface) that exhibits an essentially equal thermal coefficient of expansion. Because of this compatibility, and because the leather floor 1 in accordance with the present invention is typically used in finer homes where wood is the construction material of choice, both the floor subsurface 3 below the composite multi-layer laminate tiles 10, 11 and the underlay 30 are typically made of wood or wood composite material. The tiles 10, 11 are then permanently glued to the floor subsurface 3 by tile cement suitable to bond wood to wood. For example, the adhesive "Quick Set Up" max bond (premium grade) made by H. B. Fuller Company, 315 South Hicks Road, Palatine, Ill. 6007, is preferred.

A top plan view of the preferred embodiment of leather floor 1 comprised of composite multi-layer laminate tiles 10–11 is shown in FIG. 2. Each hexagonally-shaped laminate tile 10 typically has a width of approximately 12", six sides of approximately 7" each, and a total thickness, which varies slightly across the tile, of approximately 7/16". The parallelogram-shaped laminate tile 11 is of equal thickness. It has edges of approximately 7" and 14". The tiles 10–11 are arrangeable, amongst other patterns, to form the illustrated tessellation.

The leather floor 1 in accordance with the present invention could have been formed of differing numbers of tiles having different shapes, sizes, and thicknesses to those shapes, sizes, and thicknesses exhibited by tiles 10, 11. Indeed, the tiles can be made in veritably any shape, in any size less than a complete hide, and in any thickness that provides a thickness of leather adequate to resist wear. The tiles 10, 11 are typically in numbers, shapes, and sizes that create visually appealing floor surface pattern.

One or more of the tiles 10, 11 optionally presents a top surface embossment 11. All tiles 10 are shown embossed in FIGS. 1 and 2, but it is not necessary that all tiles of any type or types should be embossed. All embossments of tiles 10 are shown identically aligned in FIGS. 1 and 2, but this identical alignment is also not required. Typical embossment patterns include crowns, stars, olive or laurel leaves, sun patterns, and/or crests and initials. Typically not all tiles 10 are embossed, and a ⅓ proportion of embossed tiles is common.

The embossing of the tiles 10–11 preferably transpires by hydraulic pressing of a custom-carved wood block into the top surface of a wetted leather overlay 20 (shown in FIGS. 3, 4). Both the carving of the embossing block and the embossing process itself are preferably performed by hand, preferably by a master craftsman. These processes of hand carving and embossing performed with high skill result in minor variations within and between the embossed tiles 10, 11. These variations are totally consistent with the hand laid appearance of a luxury floor.

The embossing normally transpires before the tiles 10–11 are laid to form the floor 1, and before such tiles are stained and/or finished (to be discussed). The embossing is of variable depth, and typically is not deeper than 1/16". Once formed, it is permanent. The embossment 12 forms a feature which is rare upon floor surfaces, and which adds to the sensual texture and visual appeal of the leather floor 1.

A partially exploded cross-sectional view of a composite multi-layer laminate leather floor tile 10–11 in accordance with the present invention is shown in FIG. 3. A cross-sectional view of such tile, taken along aspect line 4—4 shown in FIG. 2, is shown in FIG. 4. Within the tiles 10, 11 a leather overlay 20 is adhesively bonded to a base-material underlay 30 by an adhesive layer 40. The base-material underlay is typically made of wood or wood composite. It is preferably made of Masonite® tampered very hard product board (trademark of Johns Manville Company).

The base-material underlay is typically approximately ¼ thick in its original, unmodified state. The lower surface 31 to the base-material underlay 30 is typically left in its original, substantially flat, condition.

Substantially the entire upper surface 32 to the base-material underlay 30 is modified in accordance with the present invention. Undulations are placed in the surface 32, typically by relieving surface material by process of sanding or grinding. The sanding is typically performed with a 6" rotary sander using coarse grit sandpaper. Any roughening of the surface 32 or any imparting of swirl marks is not harmful, and actually facilitates the bonding of adhesive layer 40.

The undulations, shown exaggerated in a cross sectional view within FIGS. 3, 4, are typically of depth greater than 1/64" but less than 1/16" over any lineal distance of 12" along the upper surface 32 of base-material underlay 30. The average undulation length is typically 10" minus 6" to plus 8". The collective undulations in upper surface 32 are usually substantially similar in both depth and lineal extent, consonant with the handworked process by which they are preferably created. For example, when a 6" or a 4" diameter sander, such as those available from Makita Corp., is used to relieve matrial from the upper surface 32 of the base-material underlay 30 of hexagonally-shaped tile 10 that is typically 12" in width, then the normal tendency is to create from about 2 to ⅔ complete sinusoidal undulations per workpiece tile. This makes the undulation length to typically be 6" to 16". The high and low points of the undulations are not necessarily centered or symmetrical on any one tile, or between tiles. The undulations are not necessarily of constant length, but may vary.

It is not problemsome that the high and the low points of the cyclical undulations proceed in all directions across the surface 32 of base-material underlay 30. It is also not a problem that the undulation heights between adjacent ones of tiles 10, 11 are not necessarily in phase, or matching. One reason that the undulations need not be in phase may be that there are seams 13 of depressed height between adjacent tiles 10, 11. Another reason may be that the undulations in the finished tiles 10, 11 are very slight nd almost imperceptible.

However, it is possible that the undulations are imparting a surface appearance to the leather floor 1 that subtly, almost unconsciously, suggests an underlying musculature to the leather surface. In such a hypotentical reason the seams 13 between tiles would be analogous to folds of flesh. In animals the musculature to either side of a flesh fold is not usually equal, nor at an equal gradient of increasing thickness. Perhaps this analogy to nature is the reason why leather floor 1 need not exhibit a matched thickness across seams 13 between tiles 10, Indeed, it may be more "sensuous" that the leather floor 1 should not exhibit phase matching of the undulations that are within the individual tiles 10, 11.

The overlay 20 is made of flexible tanned leather. It presents a first, relatively smoother, top side 21. This side ultimately forms the surface of leather floor 1. It presents a second, relatively rougher, bottom side 22. The leather underlay 20 is generally tan or brown in color. It is substantially planar. It typically exhibits a substantially uniform thickness (except where beveled, as will be explained) of approximately 3/16". The leather overlay 20 is initially larger than the base-material underlay 30 by approximately ⅛". When the overlay 20 is tacky to the underlay 30 then the overlay 20 is overlaid with a paper sheet and pounded into good and uniform contact with the underlay 30. As soon as the adhesive is set the overhang of leather overlay 20 is trimmed, typically with a wood chisel.

In accordance with the present invention, the peripheral edges of both the leather overlay 20 and the base-material underlay 30 are preferably beveled before being joined by adhesive layer 40 in order to form composite tiles 10, 11. The top side peripheral edge of the base-material underlay 30 is beveled at a shallow angle as indicated to form edge bevel 33. Meanwhile, the peripheral edges of the bottom side of leather overlay 20 are preferably also beveled at a shallow angle to form edge bevel 23, as indicated.

The bottom side edge bevel 23 of the leather overlay 20 is preferably both wider (by 9/16" to 11/16") and shallower (by 1/32") than the top side edge bevel 33 of the base-material underlay 30. The width of edge bevel 33 to base-material underlay 30 is typically approximately 5/16" while its depth is typically approximately ⅛" (equaling approximately ½ of the typical ¼" total thickness of base-material underlay 30). The edge bevel 33 is typically in a "S" curve, as illustrated. It is typically cut into the edge of base-material underlay 30 with a shaper. The shaper has knives, typically of very hard carbide steel, that are ground to the desired contour of edge bevel 33. The preferred "S" curve edge bevel is reminiscent of the edge of a pillow.

Meanwhile, the edge bevel 23 to leather overlay 20 is typically ⅞ to 1" in width with a depth of typically 3/32" (equaling approximately ½ the typical 3/16" thickness of leather overlay 20). The edge bevels 23 is referably created by planing, but may alternatively be created by sanding upon the bottom side of leather overlay 20.

The leather overlay 20 preferably has a burnishing groove 24 within the periphery of its upper surface 21. The groove 24, which is typically rounded or U-shaped as illustrated, is typically placed in the surface 21 by embossing at approximately 5/16" from the edge of leather overlay 20, and not by cutting. It is typically placed within the top surface 21 of the leather overlay 20 at a peripheral position that is within or closer, the tile edge then the width of edge bevel 23 within lower surface 22 extends from the same edge. This makes that the burnishing groove 24 is upon the slanted upper edge surface of the leather overlay 20 when the tile is joined, as shown in FIG. 4.

The burnishing groove 24 is decorative, as may be observed in FIGS. 1 and 2. It additionally fulfills a mechanical purpose by facilitating the downwards bending of the leather overlay 20 at its peripheral regions. This downwards bending of the leather overlay 20 is required in order that it should be adhesively bonded along the surface of its edge bevel 23 to the corresponding surface of the edge bevel 33 of the base-material underlay 30. The burnishing groove 24 is normally the last working of the file's surface that is performed, and transpires after the further beveling next discussed.

Still further bevels are preferably emplaced in both leather overlay 20 and in base-material underlay 30 in accordance with the present invention. An edge bevel 25, which is preferably round as illustrated, is preferably emplaced on the peripheral edges of upper surface 21 of leather overlay 20. This edge bevel 25 is typically cut with a trimmer, or "chamfrein" trimmer. The trimmer used is common in saddlery. If many tiles are produced, then both the bevels 25 and 34 may be cut with a router or similar machine. The edge bevel 25 helps to prevent fraying or wear of leather overlay 20 at the peripheral edges to its upper surface 21.

Meanwhile, an edge bevel 34, typically cut at an acute angle as illustrated, is preferably created at the peripheral edges to bottom surface 31 of base-material underlay 30. The purpose of this edge bevel 34 is so that when tiles 10–11 are laid in a pattern to form floor 1 (as shown in FIGS. 1 and 2) then a flooring adhesive (not shown) bonding the bottom surface 31 of each such tile to the floor subsurface 3 will accrue in abundant amounts within the cavities formed by edge bevels 34 in the seams 13 between such tiles 10, 11. The flooring adhesive at the region of edge bevels 34 between adjacent one of tiles 10, 11 will adequately secure the edges of such tiles 10, 11 against loosening from floor subsurface 3. The accumulation of flooring adhesive at the region of edge bevel 34 also protects against entry of liquids or other contaminants into the seams 13 between the tiles 10, 11, and between the tiles 10, 11 and the floor subsurface 3.

The cross-sectional appearance of an assembled leather surface floor tile 10–11 in accordance with the present invention is shown in FIG. 4. The leather overlay 20 is held to the base-material underlay 30 by an adhesive layer 40. The adhesive layer is preferably contact adhesive. The adhesive is more preferably Lockweld® type No. 400 (trademark of Lockweld Co.). The adhesive layer 40 may be rolled or brushed on either the upper surface 32 of base-material underlay 30 (as illustrated in FIG. 3), or upon the bottom side surface 22 of leather overlay 20, or upon both such surfaces. The Lockweld® adhesive is available from R. W. P. Company, 600 General Bruce Drive, Temple, Tex. 76501. Other adhesives suitable for permanently bonding leather and wood are equally suitable.

The upper surface 21 of the leather overlay 20 of the composite floor tile 10–11 shown in FIG. 4 is preferably, optionally, subject to each of staining, sealing, and waxing. A preferred stain is Angelus brand acrylic finisher, a shoe polish type stain that is recommended for use on leather. Another Angelus product, the Lexol® brand neutral luster cream wax shoe polish (trademarks of Angelus Co.), is also suitable. Both products are available from Angelus Company, Culver City, Calif. The commonly available Kiwi® brand shoe polish (trademark of Kiwi Co.) is also suitable.

Typical stain shades applied to leather overlay 20 in order to bring out natural highlights in the leather include light brown, dark brown, cordovan, and black. The tanned leather overlay 20 typically presents a substantially homogeneous tan or light brown upper surface 21 prior to staining. The act of staining causes colored stain to accumulate within the natural pores and fissures of the leather surface. The staining gives the leather an appearance which is similar to using dark shoe polish upon a dress shoe originally of a lighter colored leather. The broad range of shades so produced is generally perceived as aesthetically pleasing.

A sealing of the upper surface 21 to the composite tiles 10, 11 is preferably performed using a liquid sealer, typically varnish and more typically plastic urethane varnish. The urethane varnish, such as the preferred Varathane® brand available from Standard Brands, is preferably thinned with 5 to 10 percent mineral spirits. The sealer is typically sprayed onto the composite tiles 10, 11. Normally the tops of tiles 10, 11 receive one coat and the edges of tiles 10, 11 receive two coats. Additional sealer may also be brushed on the edges of tiles 10, 11. The sealer should be put on the leather overlay 20 and its edges and allowed to dry overnight so that the sealer may penetrate the porous leather. The varnish will dry overthin on the upper surface 21 of composite tiles 10, 11. The overthin varnish coat will neither discolor the tiles, crack, nor show other adverse effects during normal use and wear.

Both the stain and the sealer are preferably applied to the peripheral edges of tiles 10, 11 as well as to their upper surfaces prior to their adhesive affixation to floor subsurface 3 in a tessellated pattern to form leather floor 1. The stain and sealant material which is particularly placed upon the peripheral edges of the tiles 10, 11 serves to protect the tiles against such fluids as might flow into the seams 13 between tiles 10, 11 when the tiles are assembled into the leather floor 1.

When precisely dimensionally constructed, and carefully sealed, the tiles 10, 11 are normally not appreciably more readily subject to wear or deterioration at their edge regions than elsewhere upon the surface of the tile. A certain natural dark coloration occurs at the boundary seams 13 of tiles 10, 11 when they are assembled into the pattern of floor 1. This coloration makes that any extraneous particulate matter such as dust or grime that accumulates in the seams 13 between tiles 10, 1 is not visually noticeable or offensive.

The seams 13 between tiles 10, 11 when assembled into leather floor 1 are normally tight and regular, and will remain so over an extensive use life. Particularly when the base-material underlay 30 is tampered (very hard) Masonite® board or the like, no shrinkage, warpage, or splitting is ever to be expected. The seams 13 between tiles 10, 11 are preferably tight but not invisible. The contoured and colored nature of the seams 13 delineates the pattern of the floor similarly to a parquet wood or ceramic tile floor. Mosaics of different colored leathers, intricate patterns including curves, and other constructions readily achieved with leather but difficult or impossible in wood or ceramic are all contemplated by the present invention.

The leather floor 1 is optionally waxed, such as with Lexol® brand wax. It is generally subject to the same maintenance and care as any fine wood floor. The floor is adequately durable over a span of years in modest traffic areas such as dining rooms. The thick leather overlay 20 of the leather floor provides appreciable resiliency, making the floor suitable for toddlers or other persons who are prone to fall.

Visually offensive damage to the leather floor 1 is difficult to inflict. Insofar as abrasions, cuts, scrapes, and rub marks become visually distinguishable then these surface imperfections may usually be alleviated by touching up the leather in the affected regions with stains, sealers, and/or waxes as appropriate. If unacceptably severe damage is sustained to one or more of the tiles 11 then these tiles may be selectively, individually, replaced. The matching of new replacement tiles to older used tiles is relatively simple by the selected staining and scuffing of the new tiles until they substantially resemble the tiles which they replace.

In summary, the leather floor in accordance with the present invention is characterized by excellent visual aesthetic appeal as well as by good functional performance. The visual appeal is derived by a very slight, substantially imperceptible, undulation in the surface of the floor. The visual appeal of the leather floor is further improved by partitionment of the floor into a tesselated pattern of tiles plus, optionally, embossment of the tiles.

In accordance with the preceding discussion of the preferred embodiment of a leather floor in accordance with the invention, other embodiments and variations will be perceived to be possible. The leather floor could be formed from rolled material akin to linoleum instead of being formed from tiles. The surfaces of the tiles could be patterned, textured, colored or otherwise manipulated by surface treatment processes which are well known to be applied to leathers.

Although it is not recommended, the floor subsurface could itself be contoured with undulations (such as by process of sanding) and a leather overlay, typically shaped as leather tiles, could be adhesively applied directly to the undulating floor subsurface. This embodiment lacks the structural rigidity which is inherent in the laminant composite leather tiles of the preferred embodiment of leather floor 1. However, the undulations that are present in even this alternative embodiment alleviate the problem with visual flatness that inures to prior floors.

In accordance with these and other possible variations in accordance with the present invention, the present invention should be interpreted in accordance with the language of the following claims, only, and not solely in accordance with that particular embodiment within which the invention has been taught.

What is claimed is:

1. A leather floor comprising:

a substantially planar base-material underlay having an undulating upper surface;

a substantially planar substantially even thickness overlay of flexible leather; and an adhesive bonding layer permanently affixing the leather overlay to the base-material underlay;

wherein the flexible leather overlay assumes the surface undulations of the base-material underlay when bonded thereto.

2. The leather floor according to claim 1 wherein the base-material underlay and the leather overlay are each patterned as tiles of equal shape and area; and wherein each overlaid leather tile is permanently affixed by the adhesive bonding to an underlaid base-material tile to produce a composite multi-layer laminate tile.

3. A leather floor tile comprising:

a substantially planar base-material underlay patterned in a shape and area of a tile having an undulating topside surface with peripheral edges that are beveled;

a substantially planar substantially even thickness overlay of flexible leather patterned in the shape and area of the tile having at its bottom side surface peripheral edges that are beveled; and an adhesive bonding layer permanently affixing the leather overlay to the base-material underlay to produce a composite multi-layer laminate tile;

wherein the flexible leather overlay assumes the surface undulations of the base-material underlay when bonded thereto.

4. The leather floor according to claim 3 wherein the bottom side bevel of the overlaid leather tile is wider than the topside bevel of the underlaid base-material tile.

5. The leather floor according to claim 3 wherein the bottomside bevel of the overlaid leather tile is deeper than the topside bevel of the underlaid base-material tile.

6. The tile floor according to claim 3 wherein the overlaid leather tile has a peripheral burnishing groove within its top surface at a separation from the edge approximately equal to the width of the bevel within the bottom side peripheral edges of the leather tile, the groove facilitating that the leather tile should bend at and along its edge bevel so as to contact the underlaid base-material tile at the region of its edge bevel.

7. The leather floor tile according to claim 3 wherein the bottom side peripheral edges of the underlaid base-material of the laminate tile are beveled.

8. The leather floor tile according to claim 3 wherein the underlay comprises:

wood composite floorboard.

9. The leather floor tile according to claim 3 wherein the flexible leather overlay comprises:

embossing upon its top surface.

10. The leather floor tile according to claim 3 further comprising:

a stain upon the top surface of the flexible leather overlay; and a protective coating upon the stained top surface of the flexible leather overlay.

11. The leather floor tile according to claim 10 wherein the protective coating comprises:

varnish.

12. The leather floor tile according to claim 10 wherein the protective coating is also applied to the edges of both the flexible leather overlay and the base-material underlay.

13. A leather-surfaced floor tile comprising:

a substantially planar base made of wood and having an undulating top surface, the based being in a regular geometric shape suitable for incorporation in a tessellation, the base having a bevel at its top surface edges;

a substantially planar overlay made of flexible leather, the overlay being of the regular geometric shape, the overlay having a bevel at its bottom surface edges; and a bonding layer between the wood base and the leather overlay for bonding the leather overlay to the wood underlay, creating thereby a laminate leather-surfaced floor tile.

14. The floor tile according to claim 13 wherein the bottom surface edge bevel of the leather overlay is wider and deeper than the top surface edge bevel of the wood underlay.

15. The floor tile according to claim 14 wherein the leather overlay defines a peripheral burnishing groove within its top surface.

16. The floor tile according to claim 15 wherein the leather overlay is stained and varnished upon its top surface.

17. A leather floor tile comprising:

a substantially planar base-material underlay patterned in a shape and area of a tile having a topside surface with peripheral edges that are beveled;

a substantially planar substantially even thickness overlay of flexible leather patterned in the shape and area of the tile having at its bottom side surface peripheral edges that are beveled; and an adhesive bonding layer permanently affixing the leather overlay to the base-material underlay to produce a composite multi-layer laminate tie.

* * * * *